US011049427B2

(12) United States Patent
Kim et al.

(10) Patent No.: US 11,049,427 B2
(45) Date of Patent: Jun. 29, 2021

(54) FLEXIBLE DISPLAY PANEL AND FLEXIBLE DISPLAY APPARATUS HAVING THE SAME

(71) Applicant: Samsung Display Co., Ltd., Yongin-si (KR)

(72) Inventors: Wontae Kim, Hwaseong-si (KR); Jihye Kim, Hwaseong-si (KR); Jin-Wook Yang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/799,709

(22) Filed: Feb. 24, 2020

(65) Prior Publication Data

US 2020/0372845 A1 Nov. 26, 2020

(30) Foreign Application Priority Data

May 22, 2019 (KR) ..... 10-2019-0059971

(51) Int. Cl.
*G09F 9/30* (2006.01)
*G09G 3/00* (2006.01)

(52) U.S. Cl.
CPC ..... *G09G 3/008* (2013.01); *G09F 9/301* (2013.01); *G09G 2310/0275* (2013.01);
(Continued)

(58) Field of Classification Search
CPC .... G06F 1/1677; G06F 1/1675; G06F 1/1652; G06F 1/1681; G06F 1/1641; G06F 1/1618; G06F 1/1616; G06F 1/1647; G06F 1/1679; G06F 3/04166; G06F 3/04886; G06F 3/0416; G06F 3/035; G06F 2203/04102; G06F 2203/04803; G06F 2200/1637; G06F 3/1423; G06F 3/0487; G06F 1/162; G06F 1/1622; G06F 1/1692; G06F 1/165;
(Continued)

(56) References Cited

U.S. PATENT DOCUMENTS

2005/0052439 A1* 3/2005 Liou ..... G09G 3/20 345/204
2010/0298032 A1* 11/2010 Lee ..... G06F 1/1677 455/566
(Continued)

FOREIGN PATENT DOCUMENTS

CN 108766249 A 11/2018
KR 10-2014-0099133 A 8/2014
KR 10-2019-0003257 A 1/2019

*Primary Examiner* — Nitin Patel
*Assistant Examiner* — Amen W. Bogale
(74) *Attorney, Agent, or Firm* — Lewis Roca Rothgerber Christie LLP

(57) ABSTRACT

A flexible display panel includes a first display area adjacent to a first end portion of the flexible display panel and a second display area adjacent to a second end portion of the flexible display panel. The flexible display panel is scanned from the first end portion of the flexible display panel to the second end portion of the flexible display panel in a first mode. In a second mode, the flexible display panel is concurrently scanned from the first end portion of the flexible display panel to a central portion of the flexible display panel and from the second end portion of the flexible display panel to the central portion of the flexible display panel.

20 Claims, 15 Drawing Sheets

(52) U.S. Cl.
CPC ..... *G09G 2310/08* (2013.01); *G09G 2340/14* (2013.01); *G09G 2380/02* (2013.01)

(58) Field of Classification Search
CPC .. G06F 1/1615; G09G 2380/02; G09G 3/035; G09G 3/00; G09G 2340/14; G09G 2340/0492; G09G 2380/14; G09G 2380/16; G09G 3/3266; G09G 3/3659; G09G 3/3674; G09G 3/3677; G09G 3/3275; G09G 2310/02; G09G 2310/0202; G09G 2310/0205; G09G 2310/0208; G09G 2310/021; G09G 2310/0213; G09G 2310/0262; G09G 2310/0267; G09G 2310/0278; G09G 2310/0283; G09G 2310/067; H04M 1/0268; H04M 1/0216; H04M 1/0222; H04M 1/00214; H04M 1/0241; H04M 2250/16; H04M 1/0243; H04M 1/0245; H04M 1/0206; H04M 1/2247; H01L 2251/5338; H01L 51/0097; H01L 23/4985; H01L 23/5387; G02F 1/133305; G09F 9/301; G09F 11/15
See application file for complete search history.

(56) References Cited

U.S. PATENT DOCUMENTS

| | | | | |
|---|---|---|---|---|
| 2016/0117987 | A1* | 4/2016 | Byun | G09G 3/3266 345/205 |
| 2018/0102096 | A1* | 4/2018 | Lee | G09G 3/3275 |
| 2019/0018294 | A1* | 1/2019 | Shi | G09G 3/364 |

* cited by examiner

FLEXIBLE DISPLAY PANEL AND FLEXIBLE DISPLAY APPARATUS HAVING THE SAME

CROSS-REFERENCE TO RELATED APPLICATION

This application claims priority to and the benefit of Korean Patent Application No. 10-2019-0059971, filed on May 22, 2019 in the Korean Intellectual Property Office (KIPO), the entire content of which is incorporated herein by reference.

BACKGROUND

1. Field

Exemplary embodiments of the present inventive concept relate to a flexible display apparatus including a flexible display panel. More particularly, exemplary embodiments of the present inventive concept relate to a flexible display apparatus including a flexible display panel displaying symmetric images on a first display area and a second display area with respect to a folding line in a specific display mode.

2. Description of the Related Art

Generally, a display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver.

A foldable display apparatus may include a flexible display panel. The foldable display apparatus may have at least two display areas in a single flexible display panel.

SUMMARY

Aspects of exemplary embodiments of the present inventive concept provide a flexible display panel capable of displaying symmetric images on a first display area and a second display area in a specific display mode so that a plurality of users in different viewing directions may view the same image.

Aspects of exemplary embodiments of the present inventive concept also provide a flexible display apparatus including the flexible display panel.

In an exemplary embodiment of a flexible display panel according to the present inventive concept, the flexible display panel includes a first display area adjacent to a first end portion of the flexible display panel and a second display area adjacent to a second end portion of the flexible display panel. The flexible display panel is scanned from the first end portion of the flexible display panel to the second end portion of the flexible display panel in a first mode. In a second mode, the flexible display panel is concurrently scanned from the first end portion of the flexible display panel to a central portion of the flexible display panel and from the second end portion of the flexible display panel to the central portion of the flexible display panel.

In an exemplary embodiment, the first mode may be an unfolded mode in which the flexible display panel is unfolded. The second mode may be an outfolding dual view mode, in which the first display area and the second display area display an image and the flexible display panel may be folded where the first display area and the second display area are exposed outwardly.

In an exemplary embodiment, in the first mode, the first display area and the second display area may display a single continuous image and an image displayed on the first display area may be different from an image displayed on the second display area. In the second mode, the first display area and the second display area may display symmetric images with respect to a folding line where the flexible display panel is folded.

In an exemplary embodiment, in a third mode, the first display area may display an image and the second display area may not display an image.

In an exemplary embodiment, the third mode may be an outfolding single view mode, in which only the first display area may display the image and the flexible display panel may be folded where the first display area and the second display area are exposed outwardly.

In an exemplary embodiment, corresponding gate signals may be scanned from the first end portion of the flexible display panel to the central portion of the flexible display panel in the second mode and wherein corresponding gate signals may be masked from the central portion of the flexible display panel to the second end portion of the flexible display panel in the second mode. Corresponding gate signals may be scanned from the second end portion of the flexible display panel to the central portion of the flexible display panel in the second mode and wherein corresponding gate signals may be masked from the central portion of the flexible display panel to the first end portion of the flexible display panel in the second mode.

In an exemplary embodiment, the flexible display panel may further include an inactive area between the first display area and the second display area, the inactive area not displaying an image in the second mode.

In an exemplary embodiment, corresponding gate signals may be scanned from the first end portion of the flexible display panel to a first end portion of the inactive area in the second mode and wherein corresponding gate signals may be masked from the first end portion of the inactive area to the second end portion of the flexible display panel in the second mode. Corresponding gate signals may be scanned from the second end portion of the flexible display panel to a second end portion of the inactive area in the second mode and wherein corresponding gate signals may be masked from the second end portion of the inactive area to the second end portion of the flexible display panel in the second mode.

In an exemplary embodiment of a flexible display panel according to the present inventive concept, the flexible display panel includes a first display area adjacent to a first end portion of the flexible display panel and a second display area adjacent to a second end portion of the flexible display panel. The flexible display panel is scanned from the first end portion of the flexible display panel to the second end portion of the flexible display panel in a first mode. In a second mode, the flexible display panel is concurrently scanned from a central portion of the flexible display panel to the first end portion of the flexible display panel and from the central portion of the flexible display panel to the second end portion of the flexible display panel.

In an exemplary embodiment of a flexible display apparatus according to the present inventive concept, the flexible display apparatus includes a flexible display panel, a gate driver and a data driver. The flexible display panel includes a first display area adjacent to a first end portion of the flexible display panel and a second display area adjacent to a second end portion of the flexible display panel. The gate driver is configured to output a gate signal to the flexible display panel. The data driver is configured to output a data voltage to the flexible display panel. The flexible display panel is scanned from the first end portion of the flexible display panel to the second end portion of the flexible display panel in a first mode. In a second mode, the flexible display panel is concurrently scanned from the first end portion of the flexible display panel to a central portion of the flexible display panel and from the second end portion of the flexible display panel to the central portion of the flexible display panel.

In an exemplary embodiment, the first mode may be an unfolded mode in which the flexible display panel is unfolded. The second mode may be an outfolding dual view mode, in which the first display area and the second display area display an image and the flexible display panel may be folded where the first display area and the second display area are exposed outwardly.

In an exemplary embodiment, in the first mode, the first display area and the second display area may display a single continuous image and an image displayed on the first display area may be different from an image displayed on the second display area. In the second mode, the first display area and the second display area may display symmetric images with respect to a folding line where the flexible display panel is folded.

In an exemplary embodiment, in a third mode, the first display area may display an image and the second display area may not display an image.

In an exemplary embodiment, the third mode may be an outfolding single view mode, in which only the first display area may display the image and the flexible display panel may be folded where the first display area and the second display area are exposed outwardly.

In an exemplary embodiment, corresponding gate signals may be scanned from the first end portion of the flexible display panel to the central portion of the flexible display panel in the second mode and wherein corresponding gate signals may be masked from the central portion of the flexible display panel to the second end portion of the flexible display panel in the second mode. Corresponding gate signals may be scanned from the second end portion of the flexible display panel to the central portion of the flexible display panel in the second mode and wherein corresponding gate signals may be masked from the central portion of the flexible display panel to the first end portion of the flexible display panel in the second mode.

In an exemplary embodiment, at least one of stages of the gate driver may include a first switching element including a control electrode configured to receive a first clock signal, an input electrode configured to receive a vertical start signal or a previous carry signal and an output electrode connected to a first control node, a second switching element including a control electrode connected to a second control node, an input electrode configured to receive a first power voltage and an output electrode connected to an input electrode of a third switching element, the third switching element including a control electrode configured to receive a second clock signal, the input electrode connected to the output electrode of the second switching element and an output electrode connected to the first control node, a fourth switching element including a control electrode connected to the first control node, an input electrode configured to receive the first clock signal and an output electrode connected to the second control node, a fifth switching element including a control electrode configured to receive the first clock signal, an input electrode configured to receive a second power voltage and an output electrode connected to the second control node, a sixth switching element including a control electrode connected to the second control node, an input electrode configured to receive the first power voltage and an output electrode connected to an output node and a seventh switching element including a control electrode connected to the first control node, an input electrode configured to receive the second clock signal and an output electrode connected to the output node.

In an exemplary embodiment, the gate signal outputted from the stage of the gate driver is masked, a pulse of the second clock signal applied to the stage of the gate driver may be skipped.

In an exemplary embodiment, the flexible display panel may further include an inactive area between the first display area and the second display area. The inactive area not displaying an image in the second mode. Corresponding gate signals may be scanned from the first end portion of the flexible display panel to a first end portion of the inactive area in the second mode and wherein corresponding gate signals may be masked from the first end portion of the inactive area to the second end portion of the flexible display panel in the second mode. Corresponding gate signals may be scanned from the second end portion of the flexible display panel to a second end portion of the inactive area in the second mode and wherein corresponding gate signals may be masked from the second end portion of the inactive area to the second end portion of the flexible display panel in the second mode.

In an exemplary embodiment, a width of a pulse of the gate signal in the second mode may be greater than a width of a pulse of the gate signal in the first mode.

In an exemplary embodiment, a data signal applied to the data driver may include a frame data duration and a dummy data duration. A width of a pulse of the gate signal in the second mode may be equal to a width of a pulse of the gate signal in the first mode. A length of the frame data duration of the data signal in the second mode may be less than a length of the frame data duration of the data signal in the first mode. A length of the dummy data duration of the data signal in the second mode may be greater than a length of the dummy data duration of the data signal in the first mode.

According to aspects of the flexible display panel and the flexible display apparatus including the flexible display panel, a first display area and a second display area display a single image in a first mode and the first display area and the second display area display symmetric images with respect to a folding line in a second mode. Thus, a plurality of the users in different viewing directions may view the same images in the second mode. In addition, a transmitting speed of the data signal may be reduced and a width of a pulse of the gate signal may be increased in the second mode so that the power consumption may be reduced. Alternatively, the transmitting speed of the data signal is maintained and a length of a dummy duration when the data signal is not transmitted may be increased in the second mode so that the power consumption may be reduced.

BRIEF DESCRIPTION OF THE DRAWINGS

The above and other features and aspects of the present inventive concept will become more apparent by describing in detailed exemplary embodiments thereof with reference to the accompanying drawings, in which.

DETAILED DESCRIPTION

Hereinafter, the present inventive concept will be explained in detail with reference to the accompanying drawings.

Figure 1:
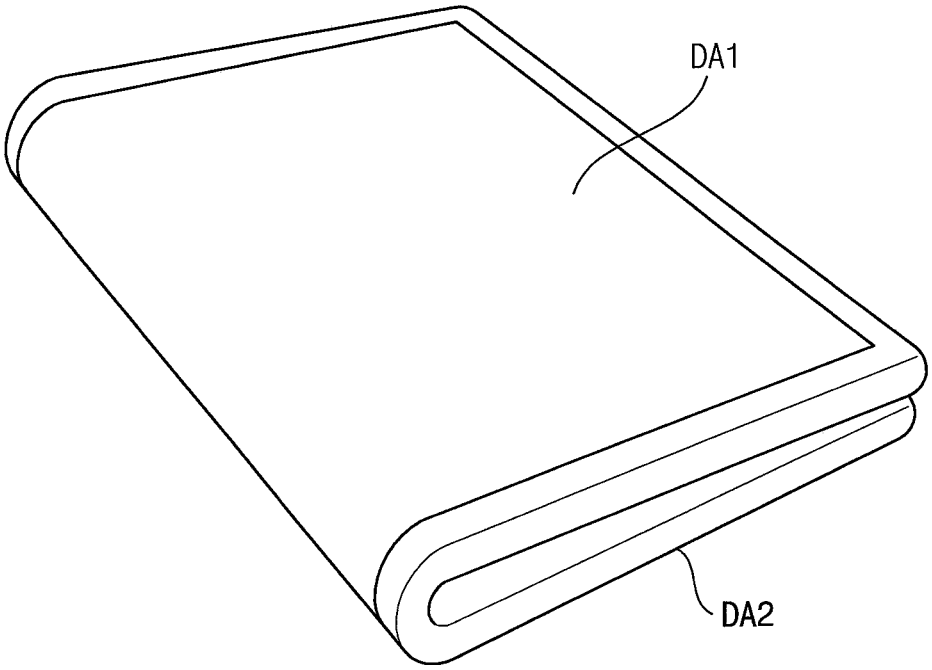
FIG. 1 is a perspective view illustrating a display apparatus according to an exemplary embodiment of the present inventive concept.
Figure 2:
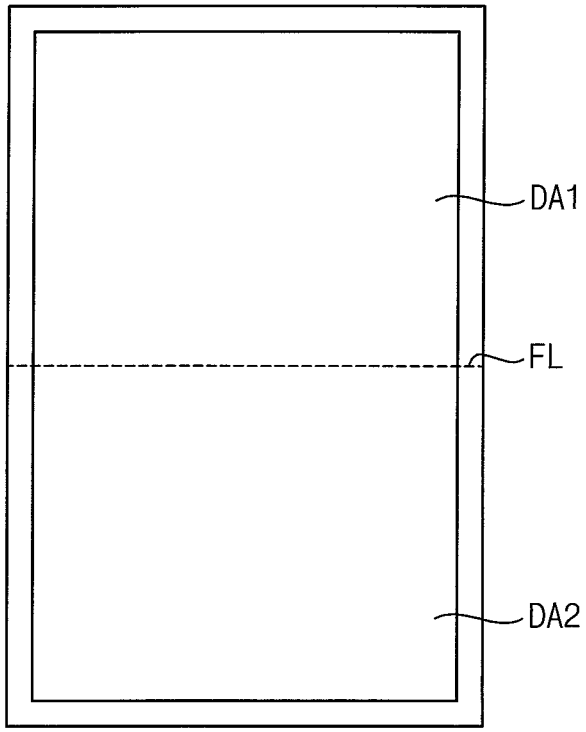
FIG. 2 is a plan view illustrating the display apparatus of FIG. 1.

FIG. 1 is a perspective view illustrating a display apparatus according to an exemplary embodiment of the present inventive concept. FIG. 2 is a plan view illustrating the display apparatus of FIG. 1.

Referring to FIGS. 1 and 2, the display apparatus may include a flexible display panel. The display apparatus may be a flexible display apparatus. The display apparatus may be a foldable display apparatus. The display apparatus may be folded along a folding line FL.

The display apparatus may include a first display area DA1 disposed in (at) a first side of the folding line FL and a second display area DA2 disposed in (at) a second side of the folding line FL.

In a first mode, the first display area DA1 and the second display area DA2 may display a single continuous image. Herein, an image displayed on the first display area DA1 may be different from an image displayed on the second display area DA2. The first mode may be a normal mode. The first mode may be an unfolded mode in which the display panel 100 is unfolded.

Figure 5:
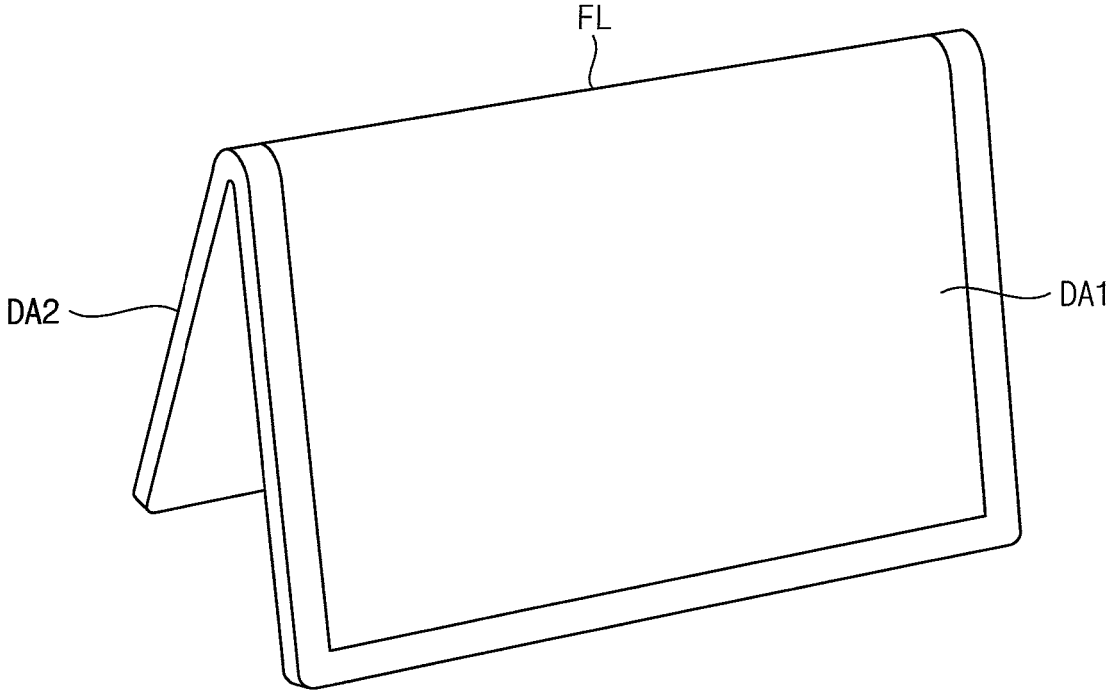
FIG. 5 is a perspective view illustrating the display apparatus of FIG. 1 in the second mode.

In a second mode, the first display area DA1 and the second display area DA2 may display symmetric images with respect to (or about) the folding line FL. In the plan view shown in FIG. 2, an image displayed on the first display area DA1 may be an inverted image of an image displayed on the second display area DA2 in a vertical direction. The second mode may be an outfolding dual view mode. In the second mode, the display panel may be folded as shown in FIG. 1. Alternatively, in the second mode, the display panel may be incompletely folded as shown in FIG. 5.

In a third mode, the first display area DA1 may display an image and the second display area DA2 may not display an image according to a user setting. Alternatively, in the third mode, the second display area DA2 may display an image and the first display area DA1 may not display an image according to a user setting. The third mode may be an outfolding single view mode. In the third mode, the display panel may be folded as shown in FIG. 1. Herein, the first display area DA1 or the second display area DA2 not displaying an image may include the first display area DA1 or the second display area DA2 displaying a black image. In other words, the display area not displaying an image may, in some exemplary embodiments, display a black image.

The first to third modes may be determined by a folded status of the flexible display panel. Alternatively, the first to third modes may be determined by a user setting, regardless of the folded status of the flexible display panel.

Figure 3:
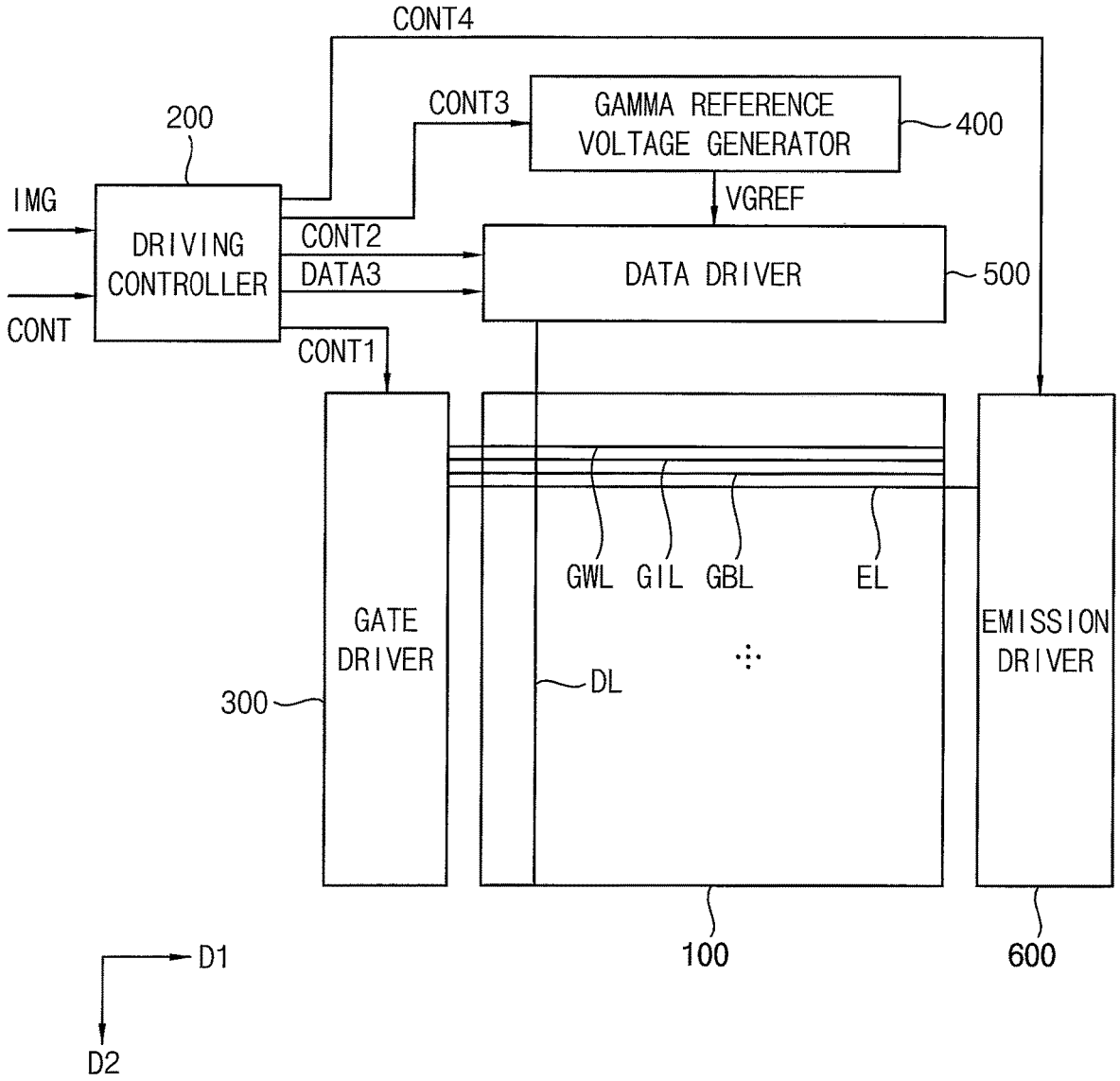
FIG. 3 is a block diagram illustrating the display apparatus of FIG. 1.

FIG. 3 is a block diagram illustrating the display apparatus of FIG. 1.

Referring to FIGS. 1-3, the display apparatus includes a display panel 100 and a display panel driver. The display panel driver includes a driving controller 200, a gate driver 300, a gamma reference voltage generator 400, a data driver 500 and an emission driver 600.

The display panel 100 has a display region on which an image is displayed and a peripheral region adjacent to the display region.

The display panel 100 includes a plurality of gate lines GWL, GIL and GBL, a plurality of data lines DL, a plurality of emission lines EL and a plurality of pixels electrically connected to the gate lines GWL, GIL and GBL, the data lines DL and the emission lines EL. The gate lines GWL, GIL and GBL extend in a first direction D1, the data lines DL extend in a second direction D2 crossing the first direction D1 and the emission lines EL extend in the first direction D1.

In the present exemplary embodiment, the display panel 100 may include the first display area DA1 disposed adjacent to a first end portion of the display panel 100 and the second display area DA2 disposed adjacent to a second end portion of the display panel 100. The first display area DA1 and the second display area DA2 may be connected to each other. The first display area DA1 and the second display area DA2 may be integrally formed. The first display area DA1 and the second display area DA2 may be divided by the folding line FL where the display panel 100 is folded.

The driving controller 200 receives input image data IMG and an input control signal CONT from an external apparatus. For example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWL, GIL and GBL in response to the first control signal CONT1 received from the driving controller 200. The gate driver 300 may sequentially output the gate signals to the gate lines GWL, GIL and GBL. In an exemplary embodiment, the gate driver 300 may be integrated on the display panel 100. In an exemplary embodiment, the gate driver 300 may be mounted on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having or being an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

Figure 4A:
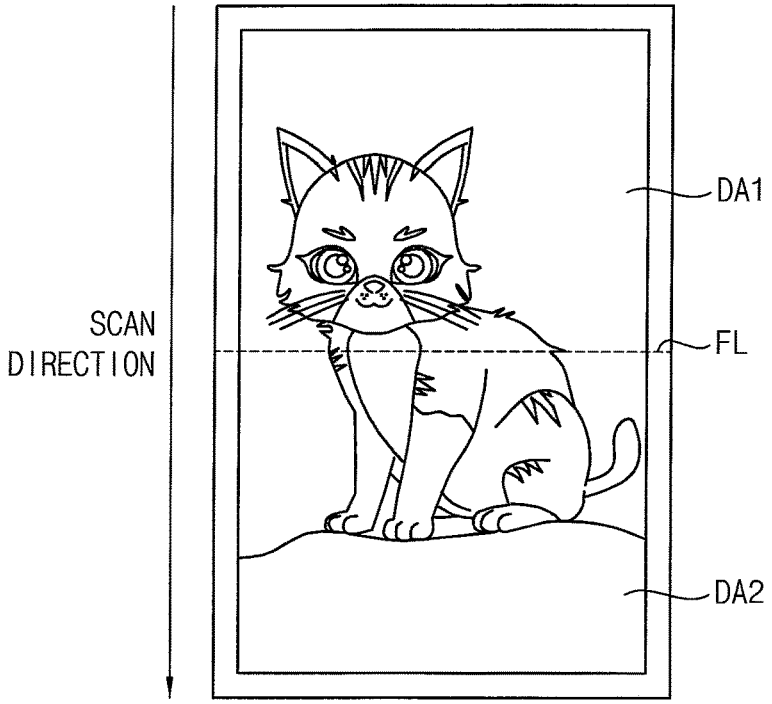
FIGS. 4A and 4B are conceptual diagrams illustrating scan directions of images displayed on the display panel of FIG. 2 in a first mode.
Figure 4B:
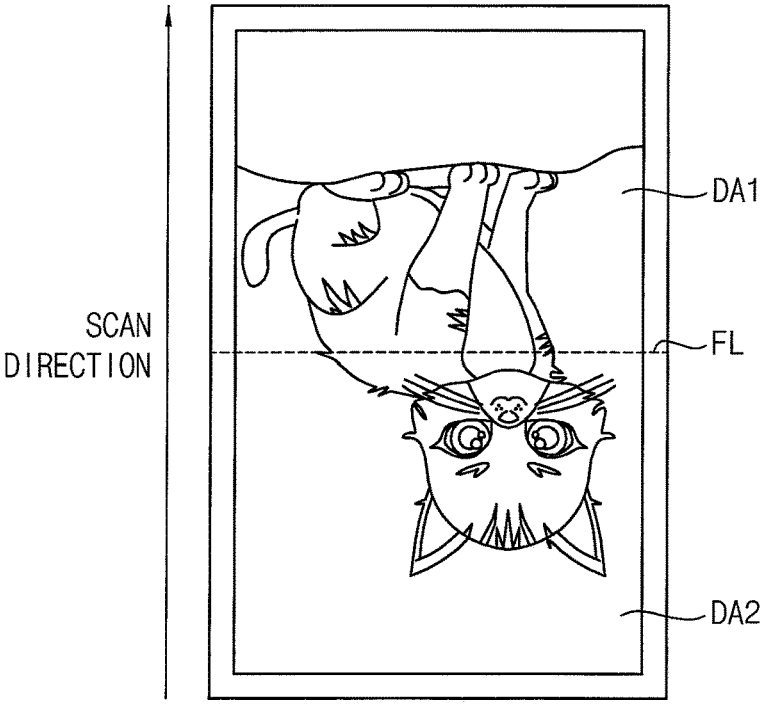

FIGS. 4A and 4B are conceptual diagrams illustrating scan directions of images displayed on the display panel 100 of FIG. 2 in a first mode.

Referring to FIGS. 1-4B, as explained above, the first display area DA1 and the second display area DA2 may display a single continuous image in the first mode.

As shown in FIG. 4A, in the first mode, the flexible display panel 100 may be scanned in a scan direction from the first end portion of the flexible display panel 100 to the second end portion of the flexible display panel 100. Herein, the scan direction may refer to a direction in which the image is sequentially displayed on the display panel 100. Herein, the scan direction may refer to a direction in which the gate signal is sequentially applied to the display panel 100.

In FIG. 4A, the image may be displayed from an upper portion of the display panel 100 to a lower portion of the display panel 100. For example, the vertical start signal may be applied to a first stage of the gate driver 300 and a carry signal may be transmitted from the first stage to a last stage of the gate driver 300 so that the gate driver 300 may output the gate signals in response to the carry signal.

When the scan direction is inverted in a vertical direction, the display panel 100 may normally display an image. The scan direction in FIG. 4B may be opposite to the scan direction in FIG. 4A.

As shown in FIG. 4B, in the first mode, the flexible display panel 100 may be scanned in a scan direction from the second end portion of the flexible display panel 100 to the first end portion of the flexible display panel 100.

In FIG. 4B, the image may be displayed from the lower portion of the display panel 100 to the upper portion of the display panel 100. For example, the vertical start signal may be applied to the last stage of the gate driver 300 and a carry signal may be transmitted from the last stage to the first stage of the gate driver 300 so that the gate driver 300 may output the gate signals in response to the carry signal.

FIG. 5 is a perspective view illustrating the display apparatus of FIG. 1 in the second mode.

Referring to FIGS. 1-5, the display panel 100 may be folded such that a plane of the first display area DA1 of the display panel 100 and a plane of the second display area DA2 of the display panel 100 form an acute angle. When the display panel 100 is stood (e.g., propped up by a lower portion of the display panel 100 and an upper portion of the display panel 100), a first user may view the image on the first display area DA1 and a second user may view the image on the second display area DA2. The image on the first display area DA1 and the image on the second display area DA2 may be symmetric to each other with respect to (or about) the folding line FL so that the first user and the second user may view the same image. The image perceived to the first user may be an inverted image of the image perceived to the second user in a horizontal direction.

Figure 6:
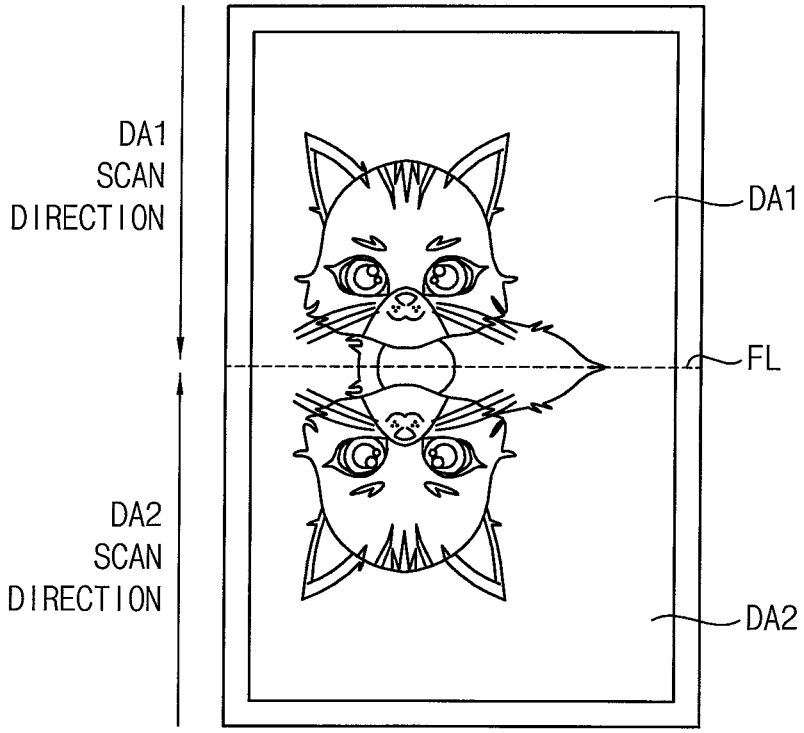
FIG. 6 is a conceptual diagram illustrating a scan direction of an image displayed on the display panel of FIG. 5 in the second mode.

FIG. 6 is a conceptual diagram illustrating the scan direction of the image displayed on the display panel 100 of FIG. 5 in the second mode.

Referring to FIGS. 1-6, in the second mode, the flexible display panel 100 may be concurrently (e.g., simultaneously) scanned from the first end portion and the second end portion of the flexible display panel 100 to a central portion of the flexible display panel 100.

For example, the data driver 500 outputs a data voltage when the first stage of the gate driver 300 adjacent to the first end portion of the display panel 100 and the last stage of the gate driver 300 adjacent to the second end portion of the display panel 100 output respective gate signals. Thus, a first row of the first display area DA1 corresponding to the first stage of the gate driver 300 and a last row of the second display area DA2 corresponding to the last stage of the gate driver 300 display the same image according to the data voltage.

For example, the data driver 500 outputs a data voltage when a second stage of the gate driver 300 adjacent to the first end portion of the display panel 100 and a second last stage of the gate driver 300 adjacent to the second end portion of the display panel 100 output respective gate signals. Thus, a second row of the first display area DA1 corresponding to the second stage of the gate driver 300 and a second last row of the second display area DA2 corresponding to the second last stage of the gate driver 300 display the same image according to the data voltage.

For example, the data driver 500 outputs a data voltage when a stage of the gate driver 300 adjacent to the central portion of the display panel 100 and in the first display area DA1 and a stage of the gate driver 300 adjacent to the central portion of the display panel 100 and in the second display area DA2 output respective gate signals. Thus, a last row of the first display area DA1 and a first row of the second display area DA2 corresponding to a central stage of the gate driver 300 display the same image according to the data voltage.

Figure 7:
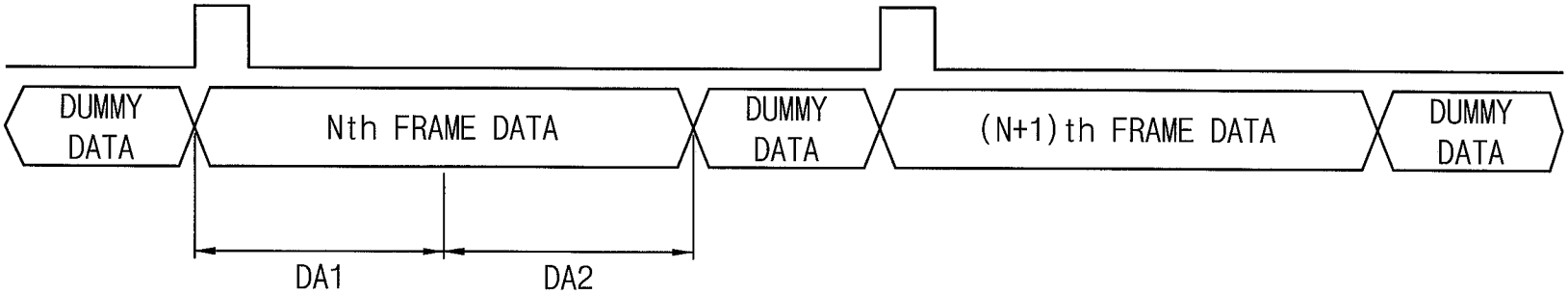
FIG. 7 is a conceptual diagram illustrating a data signal of the display apparatus of FIG. 1 in the first mode.
Figure 8:
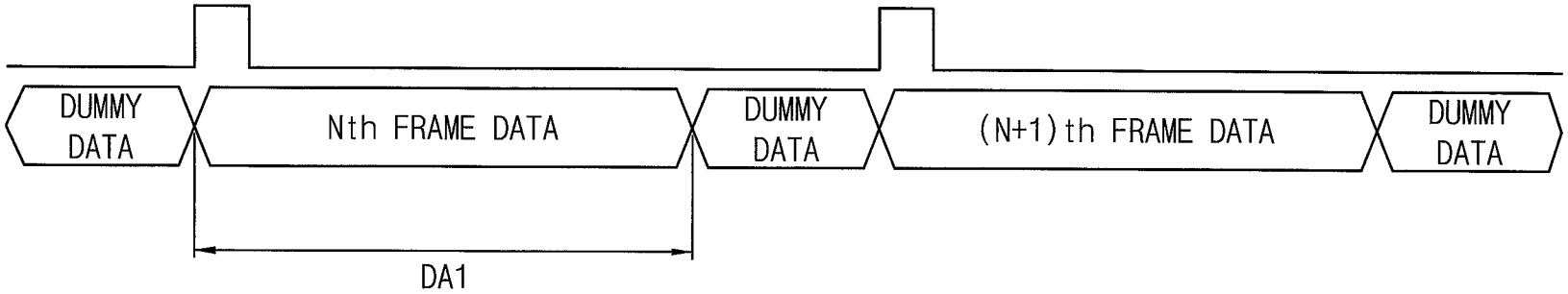
FIG. 8 is a conceptual diagram illustrating a data signal of the display apparatus of FIG. 1 in the second mode.

FIG. 7 is a conceptual diagram illustrating a data signal of the display apparatus of FIG. 1 in the first mode. FIG. 8 is a conceptual diagram illustrating a data signal of the display apparatus of FIG. 1 in the second mode.

Referring to FIGS. 1-8, the display panel 100 may display an image in a unit of a frame. As shown in FIG. 3, the driving controller 200 may output the data signal to the data driver 500. As shown in FIGS. 7-8, the data signal may include a frame data duration Nth FRAME DATA and (N+1)th FRAME DATA including a frame image and a dummy data duration DUMMY DATA not including the frame image.

FIG. 7 represents the data signal outputted from the driving controller 200 to the data driver 500 in the first mode. FIG. 8 represents the data signal outputted from the driving controller 200 to the data driver 500 in the second mode.

In the first mode, both the data signal corresponding to the first display area DA1 and the data signal corresponding to the second display area DA2 may be provided to the data driver 500. In the second mode, only the data signal corresponding to the first display area DA1 may be provided to the data driver 500. In the second mode, the first display area DA1 and the second display area DA2 display an image using the same data signal (e.g. the data signal corresponding to the first display area DA1).

When a length of the frame in the first mode is the same as (or equal to) a length of the frame in the second mode, an image transmitting speed for transmitting the frame image in the second mode may be less than an image transmitting speed for transmitting the frame image in the first mode. For example, the image transmitting speed in the second mode may be half of the image transmitting speed in the first mode. Thus, the power consumption for transmitting the data signal may be reduced in the second mode.

In addition, herein, a width of a pulse of the gate signal in the second mode may be greater than a pulse of the gate signal in the first mode. For example, the width of the pulse of the gate signal in the second mode may be twice the width of the pulse of the gate signal in the first mode. Herein, a number of rising edges of the gate signal and a number of falling edges of the gate signal may be reduced so that the power consumption for outputting the gate signal may be reduced in the second mode.

Figure 9:
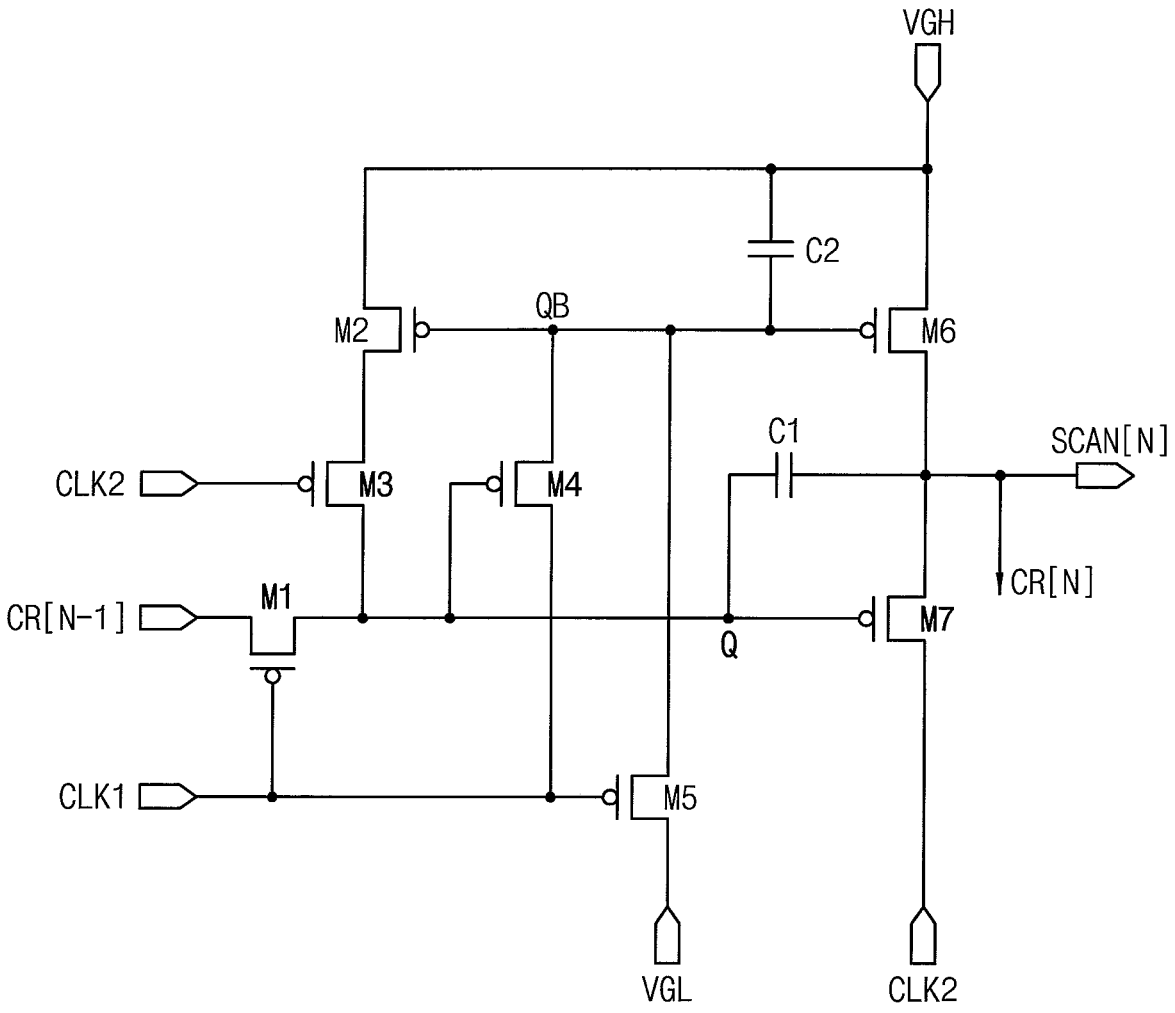
FIG. 9 is a circuit diagram illustrating a gate driver of FIG. 3.

FIG. 9 is a circuit diagram illustrating the gate driver 300 of FIG. 3.

Referring to FIGS. 1-9, at least one of stages of the gate driver 300 may include a circuit diagram of FIG. 9.

At least one of the stages of the gate driver 300 may include a first switching element M1, a second switching element M2, a third switching element M3, a fourth switching element M4, a fifth switching element M5, a sixth switching element M6, and a seventh switching element M7. The first switching element M1 including a control electrode receiving a first clock signal CLK1, an input electrode receiving a vertical start signal FLM or a previous carry signal CR[N−1] and an output electrode connected to a first control node Q. The second switching element M2 including a control electrode connected to a second control node QB, an input electrode receiving a first power voltage VGH and an output electrode connected to an input electrode of the third switching element M3. The third switching element M3 including a control electrode receiving a second clock signal CLK2, the input electrode connected to the output electrode of the second switching element M2 and an output electrode connected to the first control node Q. The fourth switching element M4 including a control electrode connected to the first control node Q, an input electrode receiving the first clock signal CLK1 and an output electrode connected to the second control node QB. The fifth switching element M5 including a control electrode receiving the first clock signal CLK1, an input electrode receiving a second power voltage VGL and an output electrode connected to the second control node QB. The sixth switching element M6 including a control electrode connected to the second control node QB, an input electrode receiving the first power voltage VGH and an output electrode connected to an output node SCAN[N]. The seventh switching element M7 including a control electrode connected to the first control node Q, an input electrode receiving the second clock signal CLK2 and an output electrode connected to the output node SCAN[N].

At least one of the stages of the gate driver 300 may further include a first capacitor C1 connected between the first control node Q and the output node SCAN[N] and a second capacitor connected between the second control node QB and a terminal receiving the first power voltage VGH.

In an exemplary embodiment, the first to seventh switching elements M1 to M7 may be thin film transistors. In an exemplary embodiment, the first to seventh switching elements M1 to M7 may be p-type thin film transistors.

In an exemplary embodiment, the output signal SCAN[N] of the output node may be one of the gate signal outputted to the gate lines GWL, GIL and GBL.

A carry signal CR[N] outputted from the output node to a next stage may be a start signal of the next stage to operate the next stage.

Figure 10:
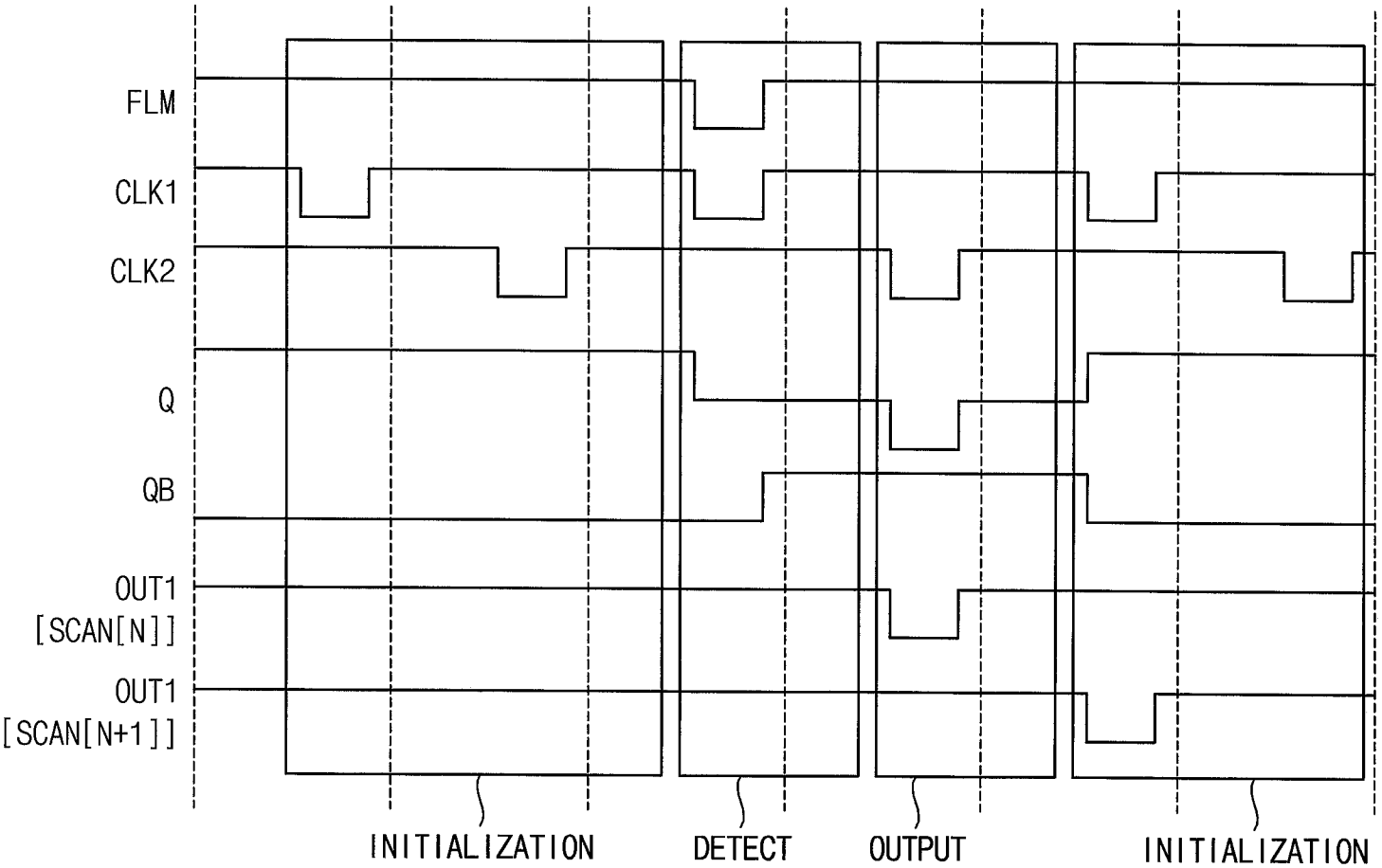
FIG. 10 is a timing diagram illustrating input signals and output signals of a stage of the gate driver of FIG. 9 in the first mode.
Figure 11:
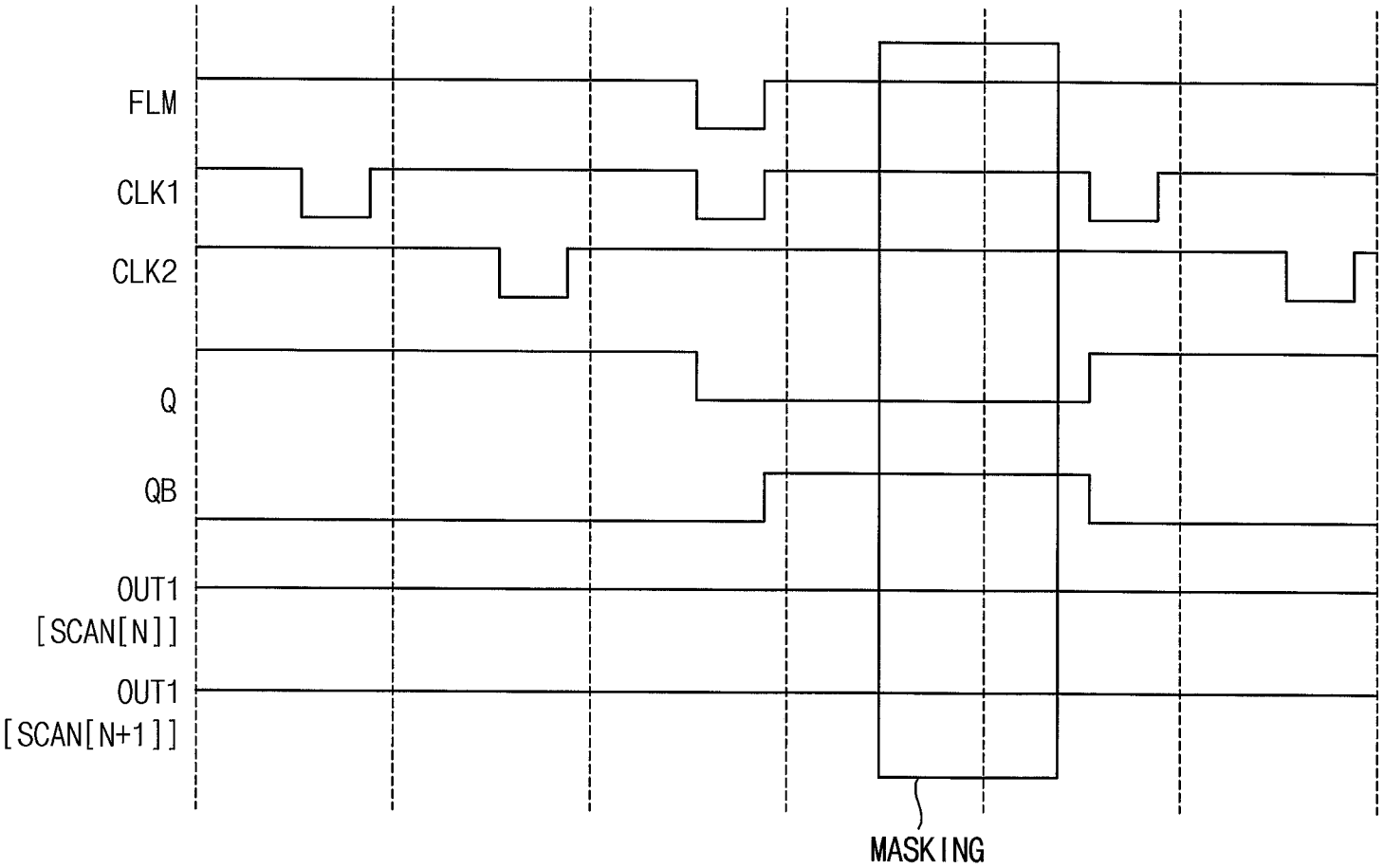
FIG. 11 is a timing diagram illustrating input signals and output signals of the stage of the gate driver of FIG. 9 in the second mode.
Figure 12A:
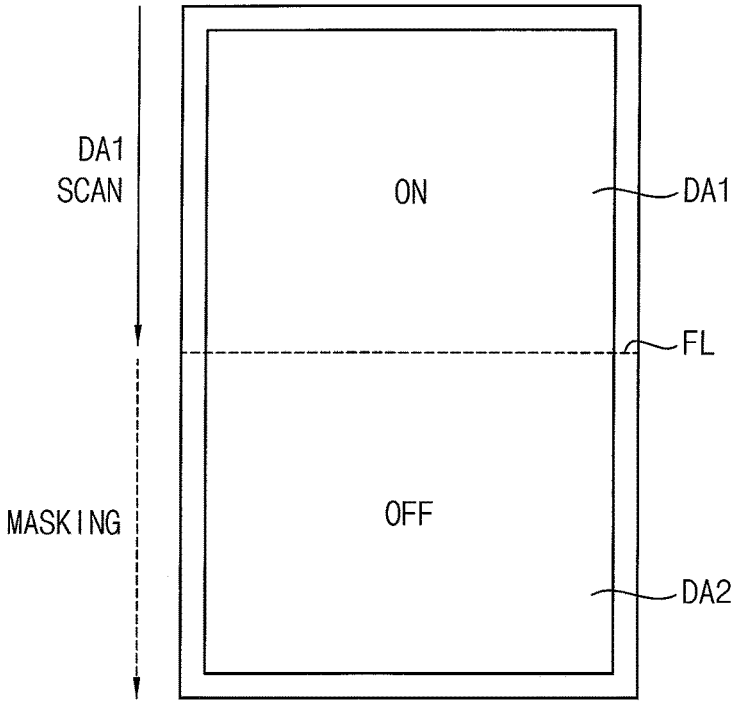
FIGS. 12A and 12B are conceptual diagrams illustrating scan directions of images displayed on the display panel of FIG. 5 in the first mode.
Figure 12B:
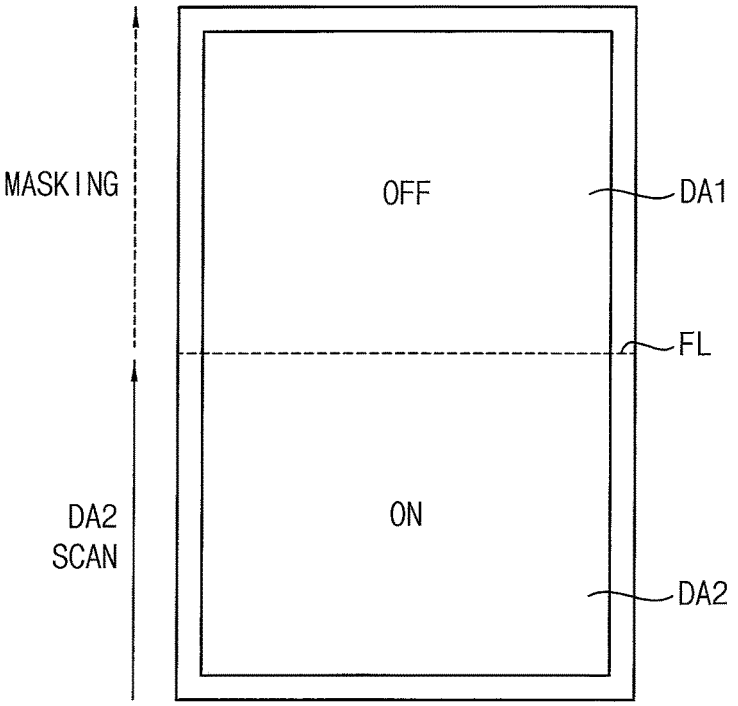

FIG. 10 is a timing diagram illustrating input signals and output signals of a stage of the gate driver of FIG. 9 in the first mode. FIG. 11 is a timing diagram illustrating input signals and output signals of the stage of the gate driver of FIG. 9 in the second mode. FIGS. 12A and 12B are conceptual diagrams illustrating scan directions of images displayed on the display panel of FIG. 5 in the first mode.

Referring to FIGS. 1-12B, FIG. 10 may represent a normal operation (a scanning operation) of the stage of the gate driver 300 and FIG. 11 may represent a skipping operation (a masking operation) of the stage of the gate driver 300. Thus, all of the stages of the gate driver 300 may operate as shown in FIG. 10 in the first mode. In contrast, some of the stages of the gate driver 300 may operate (or perform) the scanning operation as shown in FIG. 10 and the other stages of the gate driver 300 may operate (or perform) the masking operation as shown in FIG. 11 in the second mode.

When the stage is the first stage of the gate driver 300 in FIGS. 10 and 11, "FLM" in FIGS. 10 and 11 may refer to the vertical start signal. When the stage is not the first stage of the gate driver 300 in FIGS. 10 and 11, "FLM" in FIGS. 10 and 11 may refer to the previous carry signal from the previous stage.

In FIG. 10, the first clock signal CLK1 and the second clock signal CLK2 having different phases are sequentially applied to the stage before the previous carry signal FLM is applied during an INITIALIZATION period.

When a pulse of the first clock signal CLK1 and the previous carry signal FLM are applied, a voltage level of the first control node Q is decreased at a falling edge of the previous carry signal FLM and a voltage level of the second control node QB is increased at a rising edge of the previous carry signal FLM during a DETECT period.

When a pulse of the second clock signal CLK2 is applied, the voltage level of the first control node Q is further decreased and the gate signal SCAN[N] is outputted during an OUTPUT period.

After the pulse of the gate signal SCAN[N] is outputted and a subsequent pulse of the first clock signal CLK1 is applied, the voltage level of the first control node Q is increased and the voltage level of the second control node QB is decreased so that the first control node Q, the second control node QB and the output node are initialized during an INITIALIZATION period.

As shown in FIG. 10, a pulse of the OUT1 gate signal SCAN[N] of an N-th stage is synchronized with a pulse of the second clock signal CLK2, a pulse of the OUT1 gate signal SCAN[N+1] of an (N+1)th stage may be synchronized with a pulse of the first clock signal CLK1.

In FIG. 11, the first clock signal CLK1 and the second clock signal CLK2 having different phases are sequentially applied to the stage before the previous carry signal FLM is applied during an INITIALIZATION period.

When a pulse of the first clock signal CLK1 and the previous carry signal FLM are applied, a voltage level of the first control node Q is decreased at a falling edge of the previous carry signal FLM and a voltage level of the second control node QB is increased at a rising edge of the previous carry signal FLM during a DETECT period.

Unlike FIG. 10, a pulse of the second clock signal CLK2 may be skipped. When the pulse of the second clock signal CLK2 is skipped, the voltage level of the first control node Q is maintained and the gate signal SCAN[N] is not outputted during a MASKING period. When a single pulse of the second clock signal CLK2 applied to the stage of the gate driver 300 is skipped, the carry signal may not be transmitted to next stages so that all of the next stages may operate (or perform) the masking operation.

As shown in FIG. 12A, the corresponding gate signals may be scanned from the first end portion of the flexible display panel 100 to the central portion of the flexible display panel 100 in the second mode. The corresponding gate signals may be masked from the central portion of the flexible display panel 100 to the second end portion of the flexible display panel 100 in the second mode. The method of masking the gate signal is explained with reference to FIG. 11.

As shown in FIG. 12B, the corresponding gate signals may be scanned from the second end portion of the flexible display panel 100 to the central portion of the flexible display panel 100 in the second mode. The corresponding gate signals may be masked from the central portion of the flexible display panel 100 to the first end portion of the flexible display panel 100 in the second mode. The method of masking the gate signal is explained with reference to FIG. 11.

According to the present exemplary embodiment, the first display area DA1 and the second display area DA2 display a single image in the first mode and the first display area DA1 and the second display area DA2 display symmetric images with respect to (or about) the folding line FL in the second mode. Thus, a plurality of the users in different viewing directions may view the same images in the second mode. In addition, the transmitting speed of the data signal may be reduced and the width of the pulse of the gate signal may be increased in the second mode so that the power consumption may be reduced.

Figure 13:
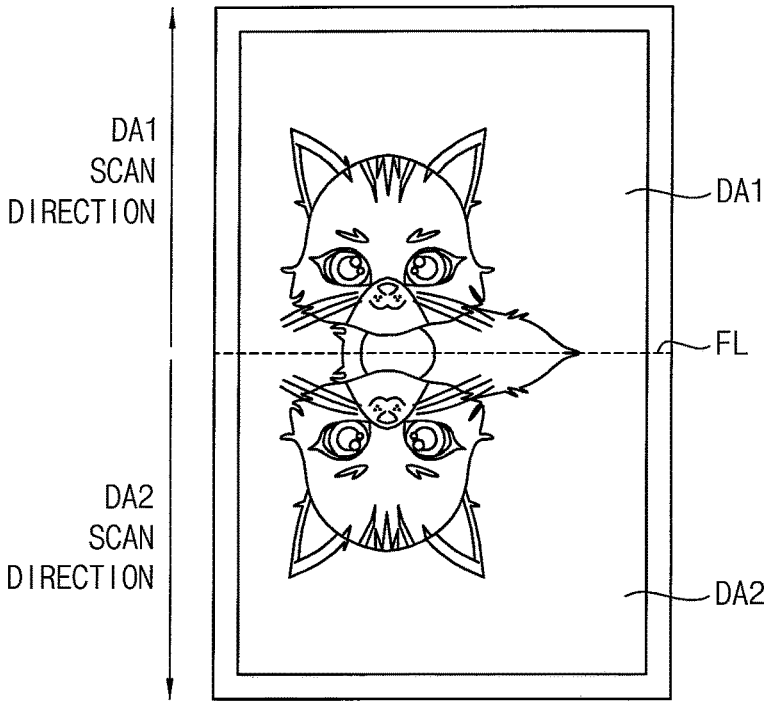
FIG. 13 is a conceptual diagram illustrating a scan direction of an image displayed on a display panel according to an exemplary embodiment of the present inventive concept in a second mode.

FIG. 13 is a conceptual diagram illustrating a scan direction of an image displayed on a display panel according to an exemplary embodiment of the present inventive concept in a second mode.

The flexible display panel and the flexible display apparatus according to the present exemplary embodiment is substantially the same as the flexible display panel and the flexible display apparatus of the previous exemplary embodiment explained with reference to FIGS. 1-12B except for the scan direction of the display panel in the second mode. Thus, the same reference numerals may be used to refer to the same or like parts as those described in the previous exemplary embodiment of FIGS. 1-12B and any redundant explanation concerning the above elements may be omitted.

Referring to FIGS. 1-5, 7-11 and 13, the display apparatus may include a flexible display panel. The display apparatus may be a flexible display apparatus. The display apparatus may be a foldable display apparatus. The display apparatus may be folded along a folding line FL.

The display apparatus may include a first display area DA1 disposed in (at) a first side of the folding line FL and a second display area DA2 disposed in (at) a second side of the folding line FL.

In a first mode, the first display area DA1 and the second display area DA2 may display a single continuous image. In a second mode, the first display area DA1 and the second display area DA2 may display symmetric images with respect to (or about) the folding line FL. In a third mode, the first display area DA1 may display an image and the second display area DA2 may not display an image.

In the second mode, the flexible display panel 100 may be concurrently (e.g., simultaneously) scanned in both directions from a central portion of the flexible display panel 100 to a first end portion of the flexible display panel 100 and from the central portion of the flexible display panel 100 to a second end portion of the flexible display panel 100.

In the present exemplary embodiment, the vertical start signal FLM may be applied to a stage corresponding to the central portion of the display panel 100.

For example, the data driver 500 outputs a data voltage when a stage of the gate driver 300 adjacent to the central portion of the display panel 100 and in the first display area DA1 and a stage of the gate driver 300 adjacent to the central portion of the display panel 100 and in the second display area DA2 output the gate signals. Thus, a last row of the first display area DA1 and a first row of the second display area DA2 corresponding to a central stage of the gate driver 300 display the same image by the data voltage.

For example, the data driver 500 outputs a data voltage when the first stage of the gate driver 300 adjacent to the first end portion of the display panel 100 and the last stage of the gate driver 300 adjacent to the second end portion of the display panel 100 output the gate signals. Thus, a first row of the first display area DA1 corresponding to the first stage of the gate driver 300 and a last row of the second display area DA2 corresponding to the last stage of the gate driver 300 display the same image by the data voltage.

According to the present exemplary embodiment, the first display area DA1 and the second display area DA2 display a single image in the first mode and the first display area DA1 and the second display area DA2 display symmetric images with respect to (or about) the folding line FL in the second mode. Thus, a plurality of the users in different viewing directions may view the same images in the second mode. In addition, the transmitting speed of the data signal may be reduced and the width of the pulse of the gate signal may be increased in the second mode so that the power consumption may be reduced.

Figure 14:
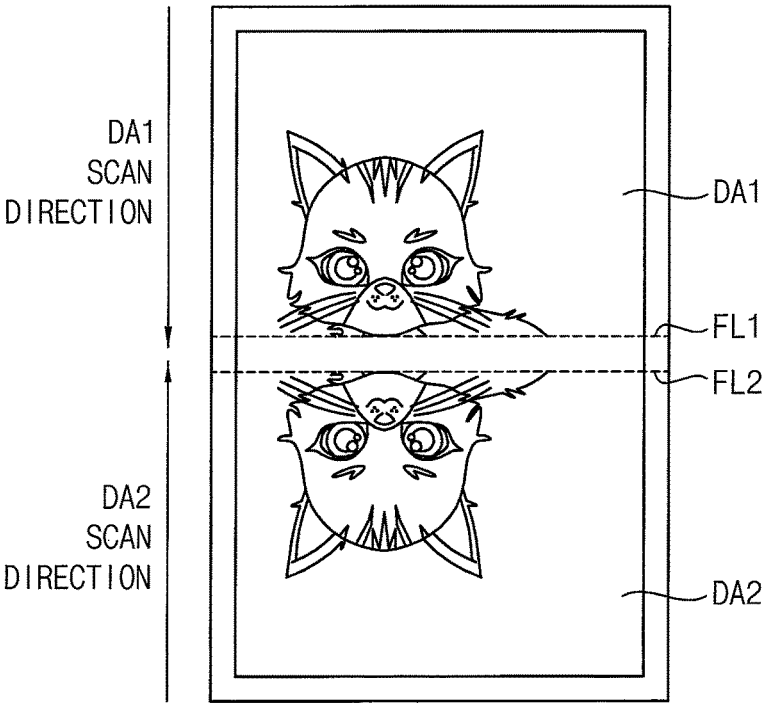
FIG. 14 is a conceptual diagram illustrating a scan direction of an image displayed on a display panel according to an exemplary embodiment of the present inventive concept in a second mode.
Figure 15A:
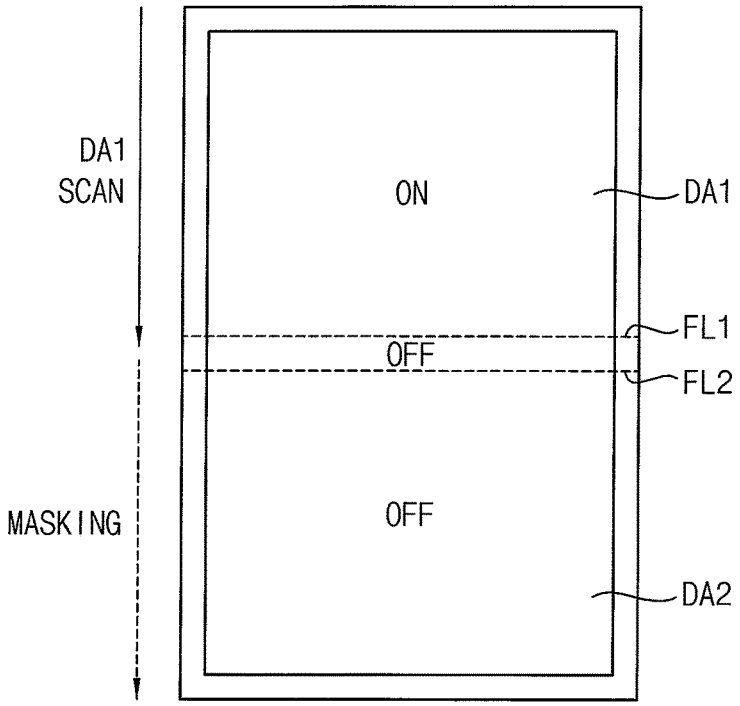
FIGS. 15A and 15B are conceptual diagrams illustrating the scan directions of the images displayed on the display panel of FIG. 14 in the second mode.
Figure 15B:
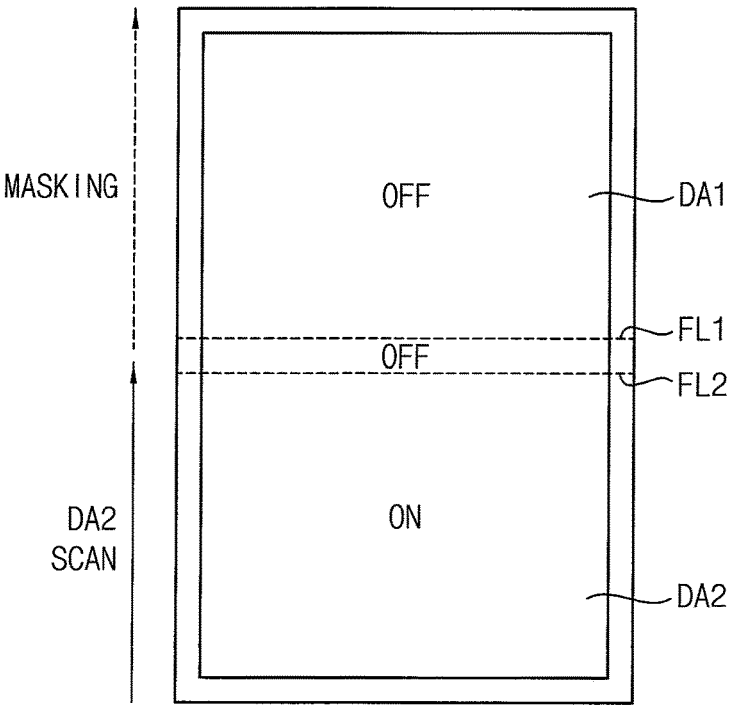

FIG. 14 is a conceptual diagram illustrating a scan direction of an image displayed on a display panel according to an exemplary embodiment of the present inventive concept in a second mode. FIGS. 15A and 15B are conceptual diagrams illustrating the scan directions of the images displayed on the display panel of FIG. 14 in the second mode.

The flexible display panel and the flexible display apparatus according to the present exemplary embodiment is substantially the same as the flexible display panel and the flexible display apparatus of the previous exemplary embodiment explained with reference to FIGS. 1-12B except that the display panel 100 further includes an inactive area between a first display area DA1 and a second display area DA2. Thus, the same reference numerals may be used to refer to the same or like parts as those described in the previous exemplary embodiment of FIGS. 1-12B and any redundant explanation concerning the above elements may be omitted.

Referring to FIGS. 1-5, 7-11, 14, 15A and 15B, the display apparatus may include a flexible display panel. The display apparatus may be a flexible display apparatus. The display apparatus may be a foldable display apparatus. The display apparatus may be folded along folding lines FL1 and FL2.

The display apparatus may include a first display area DA1 disposed in (at) a first side of the folding lines FL1 and FL2 and a second display area DA2 disposed in (at) a second side of the folding lines FL1 and FL2.

In a first mode, the first display area DA1 and the second display area DA2 may display a single continuous image. In a second mode, the first display area DA1 and the second display area DA2 may display symmetric images with respect to (or about) the folding lines FL1 and FL2. In a third mode, the first display area DA1 may display an image and the second display area DA2 may not display an image.

In the present exemplary embodiment, in the second mode, the display panel 100 may further include the inactive area between the first display area DA1 and the second display area DA2. The first display area DA1 may be defined as an area between the first end portion of the display panel 100 and the first folding line FL1. The second display area DA2 may be defined as an area between the second end portion of the display panel 100 and the second folding line FL2. The inactive area may be defined as an area between the first folding line FL1 and the second folding line FL2.

When the display apparatus is stood as shown in FIG. 5, the central portion of the display panel 100 may not be shown well (i.e., difficult to view and/or distorted) to both a first user viewing the first display area DA1 and a second user viewing the second display area DA2. Thus, the central portion of the display panel 100 not shown well to the first and second users may be set to (or as) the inactive area not displaying the image in the second mode (the outfolding dual vies mode) so that satisfaction of the users may be enhanced.

In the present exemplary embodiment, the corresponding gate signals may be scanned from the first end portion of the flexible display panel 100 to a first end portion FL1 of the inactive area in the second mode. The corresponding gate signals may be masked from the first end portion FL1 of the inactive area to the second end portion of the flexible display panel 100 in the second mode.

In addition, the corresponding gate signals may be scanned from the second end portion of the flexible display panel 100 to a second end portion FL2 of the inactive area in the second mode. The corresponding gate signals may be masked from the second end portion FL2 of the inactive area to the first end portion of the flexible display panel 100 in the second mode.

According to the present exemplary embodiment, the first display area DA1 and the second display area DA2 display a single image in the first mode and the first display area DA1 and the second display area DA2 display symmetric images with respect to (or about) the folding line FL1 and FL2 in the second mode. Thus, a plurality of the users in different viewing directions may view the same images in the second mode. In addition, the transmitting speed of the data signal may be reduced and the width of the pulse of the gate signal may be increased in the second mode so that the power consumption may be reduced.

Figure 16:
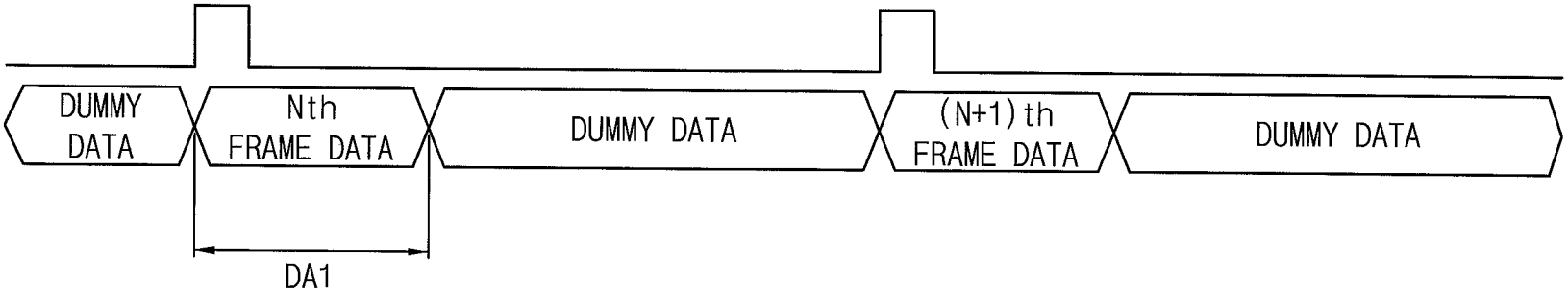
FIG. 16 is a conceptual diagram illustrating a data signal of a display apparatus according to an exemplary embodiment of the present inventive concept in a second mode.

FIG. 16 is a conceptual diagram illustrating a data signal of a display apparatus according to an exemplary embodiment of the present inventive concept in a second mode.

The flexible display panel and the flexible display apparatus according to the present exemplary embodiment is substantially the same as the flexible display panel and the flexible display apparatus of the previous exemplary embodiment explained with reference to FIGS. 1-12B except for a structure of the data signal in the second mode. Thus, the same reference numerals may be used to refer to the same or like parts as those described in the previous exemplary embodiment of FIGS. 1-12B and any redundant explanation concerning the above elements may be omitted.

Referring to FIGS. 1-7, 9-12B and 16, the display apparatus may include a flexible display panel. The display apparatus may be a flexible display apparatus. The display apparatus may be a foldable display apparatus. The display apparatus may be folded along a folding line FL.

The display apparatus may include a first display area DA1 disposed in (at) a first side of the folding line FL and a second display area DA2 disposed in (at) a second side of the folding line FL.

In a first mode, the first display area DA1 and the second display area DA2 may display a single continuous image. In a second mode, the first display area DA1 and the second display area DA2 may display symmetric images with respect to (or about) the folding line FL. In a third mode, the first display area DA1 may display an image and the second display area DA2 may not display an image.

The display panel 100 may display an image in a unit of a frame. The driving controller 200 may output the data signal to the data driver 500. The data signal may include a frame data duration Nth FRAME DATA and (N+1)th FRAME DATA including a frame image and a dummy data duration DUMMY DATA not including the frame image.

FIG. 7 represents the data signal outputted from the driving controller 200 to the data driver 500 in the first mode. FIG. 16 represents the data signal outputted from the driving controller 200 to the data driver 500 in the second mode.

In the first mode, both the data signal corresponding to the first display area DA1 and the data signal corresponding to the second display area DA2 may be provided to the data driver 500. In the second mode, only the data signal corresponding to the first display area DA1 may be provided to the data driver 500. In the second mode, the first display area DA1 and the second display area DA2 display an image using the same data signal (e.g. the data signal corresponding to the first display area DA1).

When an image transmitting speed for transmitting the frame image in the first mode is the same as (or equal to) an image transmitting speed for transmitting the frame image in the second mode, a length of a frame data duration Nth FRAME DATA and (N+1)th FRAME DATA in the second mode may be less than a length of a frame data duration Nth FRAME DATA and (N+1)th FRAME DATA in the first mode and a length of a dummy data duration DUMMY DATA in the second mode may be greater than a length of a dummy data duration DUMMY DATA in the first mode. For example, the length of the frame data duration Nth FRAME DATA and (N+1)th FRAME DATA in the second mode may be half of the length of the frame data duration Nth FRAME DATA and (N+1)th FRAME DATA in the first mode. The power consumption in (or during) the frame data duration Nth FRAME DATA and (N+1)th FRAME DATA is greater than the power consumption in (or during) the dummy data duration DUMMY DATA so that the power consumption for transmitting the data signal may be reduced in the second mode.

Herein, a width of a pulse of the gate signal in the second mode may be the same as (or equal to) a pulse of the gate signal in the first mode.

According to the present exemplary embodiment, the first display area DA1 and the second display area DA2 display a single image in the first mode and the first display area DA1 and the second display area DA2 display symmetric images with respect to (or about) the folding line FL in the second mode. Thus, a plurality of the users in different viewing directions may view the same images in the second mode. In addition, the transmitting speed of the data signal is maintained and the length of the dummy duration when the data signal is not transmitted may be increased in the second mode so that the power consumption may be reduced.

According to the present inventive concept as explained above, the power consumption of the foldable display apparatus may be reduced.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", or "adjacent to" another element or layer, it can be directly on, connected to, or adjacent to the other element or layer, or one or more intervening elements or layers may be present. In contrast, when an element or layer is referred to as being "directly on," "directly connected to", or "immediately adjacent to" another element or layer, there are no intervening elements or layers present.

As used herein, the terms "use," "using," and "used" may be considered synonymous with the terms "utilize," "utilizing," and "utilized," respectively.

The display devices and/or any other relevant devices or components according to embodiments of the present disclosure described herein, such as, for example, an driving controller, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims, and equivalents thereof. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims, and equivalents thereof. The present inventive concept is defined by the following claims, with equivalents of the claims to be included therein.

What is claimed is:

1. A flexible display panel comprising:

a first display area adjacent to a first end portion of the flexible display panel and a second display area adjacent to a second end portion of the flexible display panel, wherein the flexible display panel is scanned from the first end portion of the flexible display panel to the second end portion of the flexible display panel in a first mode, wherein, in a second mode, the flexible display panel is concurrently scanned from the first end portion of the flexible display panel to a central portion of the flexible display panel and from the second end portion of the flexible display panel to the central portion of the flexible display panels, wherein the first mode is an unfolded mode in which the flexible display panel is unfolded, and wherein the second mode is an outfolding dual view mode, in which the first display area and the second display area display an image and the flexible display panel is folded where the first display area and the second display area are exposed outwardly.

2. The flexible display panel of claim 1, wherein, in a third mode, the first display area displays an image and the second display area does not display an image.

3. The flexible display panel of claim 2, wherein the third mode is an outfolding single view mode, in which only the first display area displays the image and the flexible display panel is folded where the first display area and the second display area are exposed outwardly.

4. The flexible display panel of claim 1, wherein corresponding gate signals are scanned from the first end portion of the flexible display panel to the central portion of the flexible display panel in the second mode and wherein corresponding gate signals are masked from the central portion of the flexible display panel to the second end portion of the flexible display panel in the second mode, and wherein corresponding gate signals are scanned from the second end portion of the flexible display panel to the central portion of the flexible display panel in the second mode and wherein corresponding gate signals are masked from the central portion of the flexible display panel to the first end portion of the flexible display panel in the second mode.

5. The flexible display panel of claim 1, further comprising an inactive area between the first display area and the second display area, the inactive area not displaying an image in the second mode.

6. The flexible display panel of claim 5, wherein corresponding gate signals are scanned from the first end portion of the flexible display panel to a first end portion of the inactive area in the second mode and wherein corresponding gate signals are masked from the first end portion of the inactive area to the second end portion of the flexible display panel in the second mode, and wherein corresponding gate signals are scanned from the second end portion of the flexible display panel to a second end portion of the inactive area in the second mode and wherein corresponding gate signals are masked from the second end portion of the inactive area to the second end portion of the flexible display panel in the second mode.

7. The flexible display panel of claim 1, wherein the first display area and the second display area constitute a single integrated display area.

8. A flexible display panel comprising:

a first display area adjacent to a first end portion of the flexible display panel and a second display area adjacent to a second end portion of the flexible display panel, wherein the flexible display panel is scanned from the first end portion of the flexible display panel to the second end portion of the flexible display panel in a first mode, wherein, in a second mode, the flexible display panel is concurrently scanned from the first end portion of the flexible display panel to a central portion of the flexible display panel and from the second end portion of the flexible display panel to the central portion of the flexible display panel, wherein, in the first mode, the first display area and the second display area display a single continuous image and an image displayed on the first display area is different from an image displayed on the second display area, and wherein, in the second mode, the first display area and the second display area display symmetric images with respect to a folding line where the flexible display panel is folded.

9. A flexible display panel comprising:

a first display area adjacent to a first end portion of the flexible display panel and a second display area adjacent to a second end portion of the flexible display panel, wherein the flexible display panel is scanned from the first end portion of the flexible display panel to the second end portion of the flexible display panel in a first mode, wherein, in a second mode, the flexible display panel is concurrently scanned from a central portion of the flexible display panel to the first end portion of the flexible display panel and from the central portion of the flexible display panel to the second end portion of the flexible display panel, wherein the first mode is an unfolded mode in which the flexible display panel is unfolded, and wherein the second mode is an outfolding dual view mode, in which the first display area and the second display area display an image and the flexible display panel is folded where the first display area and the second display area are exposed outwardly.

10. A flexible display apparatus comprising:

a flexible display panel comprising a first display area adjacent to a first end portion of the flexible display panel and a second display area adjacent to a second end portion of the flexible display panel;

a gate driver configured to output a gate signal to the flexible display panel; and a data driver configured to output a data voltage to the flexible display panel, wherein the flexible display panel is scanned from the first end portion of the flexible display panel to the second end portion of the flexible display panel in a first mode, wherein, in a second mode, the flexible display panel is concurrently scanned from the first end portion of the flexible display panel to a central portion of the flexible display panel and from the second end portion of the flexible display panel to the central portion of the flexible display panel, wherein the first mode is an unfolded mode in which the flexible display panel is unfolded, and wherein the second mode is an outfolding dual view mode, in which the first display area and the second display area display an image and the flexible display panel is folded where the first display area and the second display area are exposed outwardly.

11. The flexible display apparatus of claim 10, wherein, in the first mode, the first display area and the second display area display a single continuous image and an image displayed on the first display area is different from an image displayed on the second display area, and wherein, in the second mode, the first display area and the second display area display symmetric images with respect to a folding line where the flexible display panel is folded.

12. The flexible display apparatus of claim 10, wherein, in a third mode, the first display area displays an image and the second display area does not display an image.

13. The flexible display apparatus of claim 12, wherein the third mode is an outfolding single view mode, in which only the first display area displays the image and the flexible display panel is folded where the first display area and the second display area are exposed outwardly.

14. The flexible display apparatus of claim 10, wherein corresponding gate signals are scanned from the first end portion of the flexible display panel to the central portion of the flexible display panel in the second mode and wherein corresponding gate signals are masked from the central portion of the flexible display panel to the second end portion of the flexible display panel in the second mode, and wherein corresponding gate signals are scanned from the second end portion of the flexible display panel to the central portion of the flexible display panel in the second mode and wherein corresponding gate signals are masked from the central portion of the flexible display panel to the first end portion of the flexible display panel in the second mode.

15. The flexible display apparatus of claim 14, wherein at least one of stages of the gate driver comprises:

a first switching element comprising a control electrode configured to receive a first clock signal, an input electrode configured to receive a vertical start signal or a previous carry signal and an output electrode connected to a first control node;

a second switching element comprising a control electrode connected to a second control node, an input electrode configured to receive a first power voltage and an output electrode connected to an input electrode of a third switching element;

the third switching element comprising a control electrode configured to receive a second clock signal, the input electrode connected to the output electrode of the second switching element and an output electrode connected to the first control node;

a fourth switching element comprising a control electrode connected to the first control node, an input electrode configured to receive the first clock signal and an output electrode connected to the second control node;

a fifth switching element comprising a control electrode configured to receive the first clock signal, an input electrode configured to receive a second power voltage and an output electrode connected to the second control node;

a sixth switching element comprising a control electrode connected to the second control node, an input electrode configured to receive the first power voltage and an output electrode connected to an output node; and a seventh switching element comprising a control electrode connected to the first control node, an input electrode configured to receive the second clock signal and an output electrode connected to the output node.

16. The flexible display apparatus of claim 15, wherein when the gate signal outputted from the stage of the gate driver is masked, a pulse of the second clock signal applied to the stage of the gate driver is skipped.

17. The flexible display apparatus of claim 10, wherein the flexible display panel further comprises an inactive area between the first display area and the second display area, the inactive area not displaying an image in the second mode, wherein corresponding gate signals are scanned from the first end portion of the flexible display panel to a first end portion of the inactive area in the second mode and wherein corresponding gate signals are masked from the first end portion of the inactive area to the second end portion of the flexible display panel in the second mode, and wherein corresponding gate signals are scanned from the second end portion of the flexible display panel to a second end portion of the inactive area in the second mode and wherein corresponding gate signals are masked from the second end portion of the inactive area to the second end portion of the flexible display panel in the second mode.

18. The flexible display apparatus of claim 10, wherein a width of a pulse of the gate signal in the second mode is greater than a width of a pulse of the gate signal in the first mode.

19. The flexible display apparatus of claim 10, wherein:

a data signal applied to the data driver comprises a frame data duration and a dummy data duration, a width of a pulse of the gate signal in the second mode is equal to a width of a pulse of the gate signal in the first mode, a length of the frame data duration of the data signal in the second mode is less than a length of the frame data duration of the data signal in the first mode, and a length of the dummy data duration of the data signal in the second mode is greater than a length of the dummy data duration of the data signal in the first mode.

20. The flexible display apparatus of claim 10, wherein the first display area and the second display area constitute a single integrated display area.

* * * * *